US005400901A

United States Patent [19]

Harrelson

[11] Patent Number: 5,400,901

[45] Date of Patent: Mar. 28, 1995

[54] BASKET-STYLE CARRIER WITH REMOVABLE HANDLE

[75] Inventor: Glen R. Harrelson, Roswell, Ga.

[73] Assignee: Riverwood International Corporation, Atlanta, Ga.

[21] Appl. No.: 260,851

[22] Filed: Jun. 16, 1994

[51] Int. Cl.[6] ..... B65D 71/00

[52] U.S. Cl. ..... 206/143; 206/162; 206/196; 206/200; 206/807

[58] Field of Search ..... 206/141, 142, 143, 162, 206/193, 194, 196, 200, 427, 807

[56] References Cited

U.S. PATENT DOCUMENTS

| | | | |
|---|---|---|---|
| 3,640,380 | 2/1972 | Huffman | 206/194 X |
| 3,747,801 | 7/1973 | Graser . | |
| 4,201,322 | 5/1980 | Crawford | 206/194 X |
| 4,250,992 | 2/1981 | Gilbert | 206/162 |
| 4,300,680 | 11/1981 | Champlin . | |
| 4,375,258 | 3/1983 | Crayne et al. . | |
| 4,424,901 | 1/1984 | Lanier . | |
| 4,493,415 | 1/1985 | Wood | 206/141 X |
| 5,167,325 | 12/1992 | Sykora | 206/141 X |
| 5,191,976 | 3/1993 | Stout et al. | 206/162 X |

*Primary Examiner*—Jacob K. Ackun

[57] ABSTRACT

A basket-style carrier having a pilfer-proof handle. The carrier has an external handle panel and an internal handle panel directly beneath it. Intermediate panels, containing openings through which the tops of articles extend, connect the side panels Of the carrier to the external handle panel and prevent individual articles from being removed from the carrier. When the intermediate panels and the external handle panel are removed along easily severed lines, the internal handle panel is exposed and can be used to lift the carrier.

18 Claims, 3 Drawing Sheets

BASKET-STYLE CARRIER WITH REMOVABLE HANDLE

FIELD OF THE INVENTION

This invention relates to a basket-style carrier for carrying articles such as beverage bottles. More particularly, it relates to a basket-style carrier incorporating structure for preventing premature removal of the bottles.

BACKGROUND OF THE INVENTION

One of the types of carriers commonly employed to package beverage bottles, particularly long-necked bottles, is the basket-style carrier. These carriers include a separate cell for each bottle and a center handle partition. They are easily lifted and carried, they have excellent strength and the cell dividers protect the bottles against contact with adjacent bottles. Basket-style carriers have long been associated with the packaging of premium products, as their design allows the bottle necks to be seen. Moreover, if the bottles are not disposable, they can be returned in the same carrier since the carrier is not destroyed by removal of the bottles.

A drawback of basket-style carriers is the ease with which individual bottles can be removed prior to the sale of the entire carrier. The carriers are normally on display in retail outlets, and there is little to prevent individual bottles from being taken prematurely from a package. It would be highly desirable to be able to prevent this from happening without detracting from the beneficial features of basket-style carriers, including the ability to use the carrier to return used bottles.

BRIEF SUMMARY OF THE INVENTION

The invention provides a basket-style carrier with a pilfer-proof handle. An external handle panel is connected to opposite side panels by intermediate panels, and easily severed means are provided for removing the intermediate panels and the attached outer handle panel from the carrier. An internal handle panel located beneath the outer handle panel is connected to the end panels, and dividers extend from the internal handle panel to the side panels to form article-receiving cells. In a preferred arrangement the intermediate panels include openings through which upper portions of articles packaged in the carrier extend.

The internal handle panel is preferably comprised of two plies of material, each ply being integrally connected to one of the end panels, and may be further reinforced by another integrally connected ply to make the handle of three-ply thickness. The external handle panel is preferably comprised of two outer and two inner plies of material, each of the outer plies being foldably connected to an associated intermediate panel.

Because the intermediate panels prevent removal of articles unless the designed tear-away feature is activated, individual articles cannot be prematurely removed from the carrier. Further, after the intermediate panels and connected outer handle panel are removed, the remaining internal handle panel allows the carrier to be carried, with either full or empty articles in the carrier cells.

These and other features and aspects of the invention will be readily ascertained from the detailed description of the preferred embodiment described below.

DETAILED DESCRIPTION OF THE PREFERRED EMBODIMENT

Figure 1:
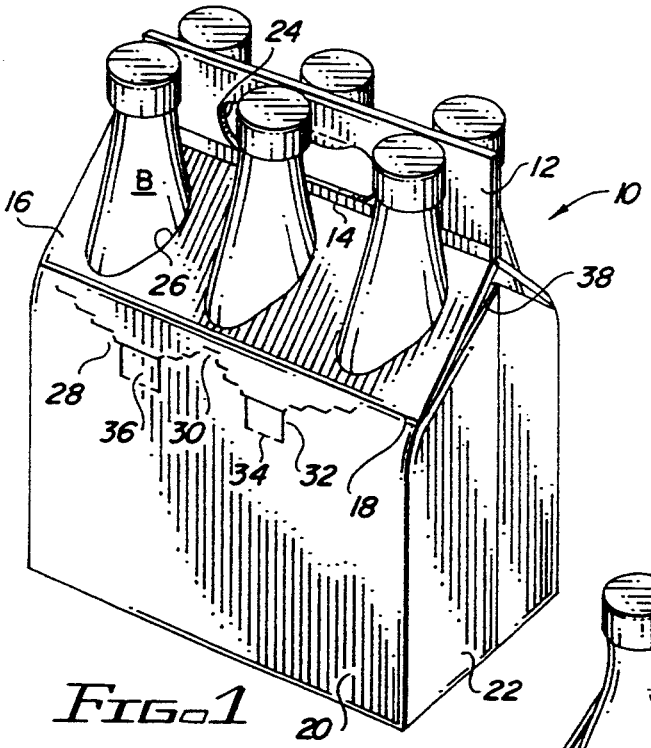
FIG. 1 is a pictorial view of the carrier of the invention, shown holding six long-necked bottles.

Referring to FIG. 1, the basket-style carrier 10 of the invention includes a central external handle panel 12 connected by fold line 14 to sloped panel section 16, which in turn is connected by fold line 18 to the side panel 20. The opposite side of the carrier is similarly constructed. The side panels are also connected to end panels 22 and to a bottom panel, not visible in this view. As illustrated, the end panels are not connected to the sloped panel sections 16, being spaced from them a short distance. An opening 24 in the handle panel 12 enables the carrier to be readily lifted, and openings 26 in the sloped panel sections 16 receive the necks of bottles B. Because the openings 26 are smaller than the diameter of the base portions of the bottles, the sloped panel sections 16 prevent removal of the bottles. Although the carrier is shown as being designed to hold three bottles on either side of the handle panel, it will be understood that it can be modified to hold fewer or more bottles.

Extending into the side panel 20 from points adjacent the ends of the fold line 18 is an easily severed line 28 formed by adjacent horizontal slits 30. Two pairs of spaced vertical slits 32 extend down from the lowermost slits 30, each pair being connected at their lower ends by fold lines 34 to form tabs 36. When it is desired to gain access to the bottles, a user merely has to push the tabs in, causing them to fold down into the interior of the carrier. This exposes the lowermost edges of the tear line, which can the be readily severed by exerting an upward force against the tear line edges. By severing the tear line on both sides of the carrier the entire handle section, comprised of the handle panel 12 and the two sloped panel sections 16, can be removed by lifting the handle section up over the tops of the bottles.

Figure 2:
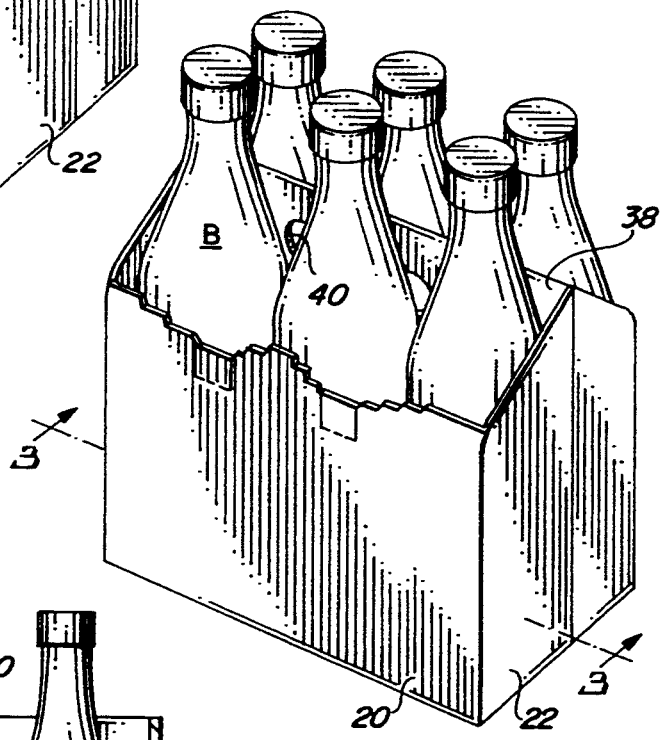
FIG. 2 is a pictorial view of the carrier of FIG. 1 after the external handle panel has been removed.
Figure 3:
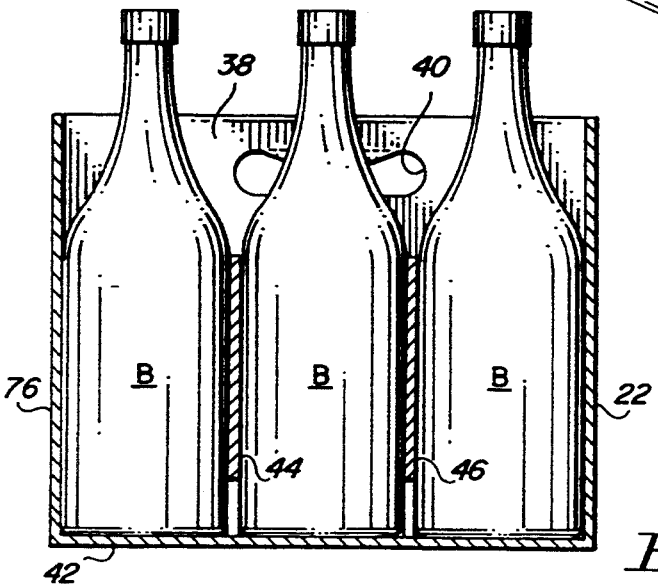
FIG. 3 is a sectional view taken on line 3—3 of FIG. 2.

The carrier as it appears after the external handle section has been removed is shown in FIGS. 2 and 3. An internal handle panel 38 containing a handle opening 40 extends between opposite end panels. An end portion of the handle panel 38 can also be seen in FIG. 1. The bottles are supported on the bottom panel 42 and adjacent bottles in each row are separated from each other by cell dividers 44 and 46. The handle panel 38 permits the carrier to be lifted and carried after the outer handle section has been removed, whether the bottles are still full or empty.

Figure 4:
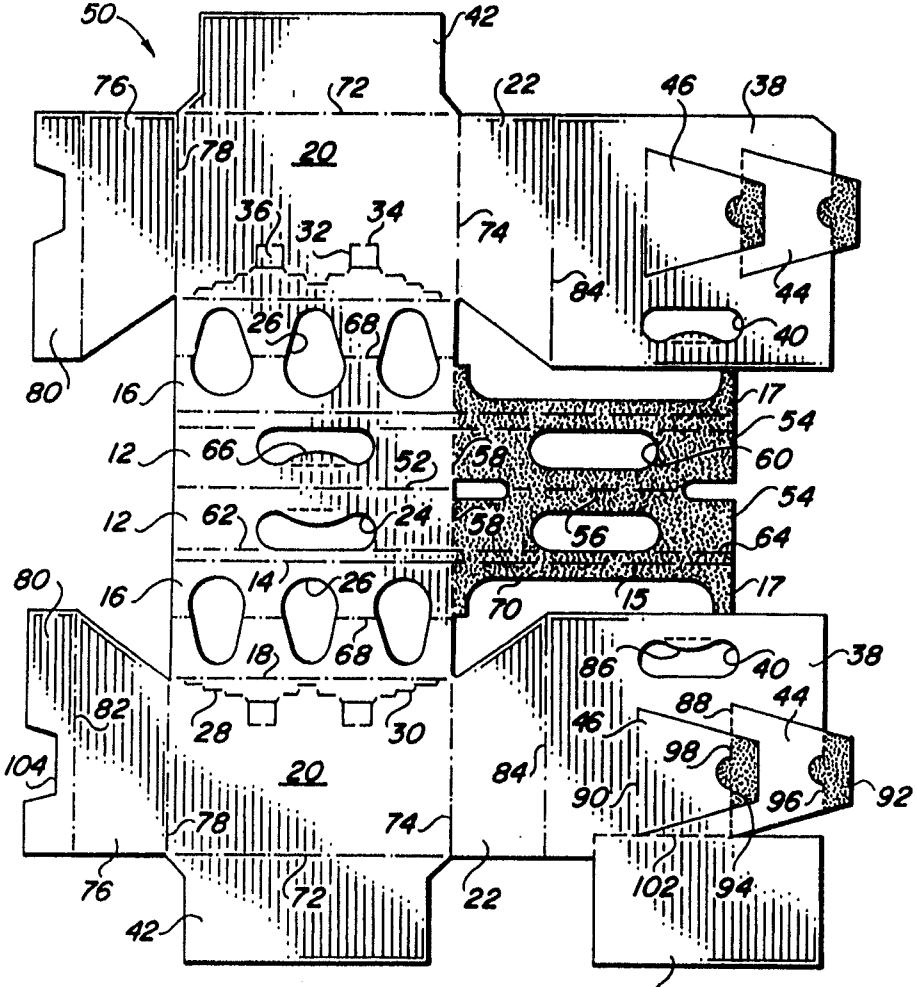
FIG. 4 is a plan view of a blank for fabricating the carrier.

Referring now to FIG. 4, wherein like reference numerals to those used in FIGS. 1–3 denote like elements, a blank 50 for forming the carrier is shown as being of generally rectangular shape. Preferably, the blank is formed from paperboard of the type conventionally used in the carrier industry. Centrally located at the left side of the blank are two similar outer-ply handle panel sections 12 connected together by fold line 52. Immediately to the right of the panel sections 12 are two similar inner-ply handle sections 54, which are connected to each other by fold line 56 and to the panel sections 12 by fold line 58. The inner-ply handle panel sections 54 contain handle openings 60 which are adapted to underlie the handle openings 24 of the outer-ply handle panel sections 12. The fold line 56, which is a continuation of fold line 52, is shown to terminate at cutouts provided for the purpose of facilitating folding. The handle panel sections also include score lines 62 and 64 which coincide with the outer edges of the handle openings 24 and 60, respectively. These score lines allow the handle panel to flex in this area to better conform to the angle of the intermediate panel 16 of the carrier. In addition, the handle openings 24 include a short tab or flap 66 adapted to be folded under the edge of the handle opening when the carrier is lifted by the handle.

The fold lines 14 connect the outer-ply handle panel sections 12 to sloped panel sections 16 which contain the bottle neck openings 26 and a score line 68 which is interrupted by the openings 26. The score line 68 allows the intermediate sloped panel section 16 to flex to better follow the contour of the bottles in this area. Connected to the sloped panel sections 16 by the fold lines 18 are the side panel sections 20. The inner-ply handle panel sections 54 are connected to inner sloped panel sections 17 by fold line 15, which is a continuation of the fold line 14, and to the outer sloped panel sections 16 by continuations of the fold line 58. The inner sloped panel sections include cutout areas 70 which serve to remove material which would otherwise block the bottle neck cutouts 26 in a carrier formed from the blank.

Connected to the side panel sections along fold lines 72 are bottom panel flaps 42. End panel sections 22 are connected to the right edge of side panel sections 20 by fold lines 74 and end panel flaps 76 are connected to the opposite edge of the side panel sections by fold lines 78. The fold lines 74 and 78 are aligned with the edges of the sloped panel sections 16. Short glue flaps 80 are connected to the end panel sections 76 by fold lines 82. Connected to the end panel sections 22 by fold lines 84 are the handle panel sections 38 which include the handle openings 40. As in the handle openings 24, the openings 40 may include short flaps 86 similar to the flaps 66. Divider flaps 44 and 46 are connected to the internal panel sections 38 by fold lines 88 and 90, respectively, and include outer glue flaps 92 and 94 connected along fold lines 96 and 98. A center panel reinforcing flap 100 is connected to the lower handle panel section 38 along fold line 102, at which line the lower ends of the fold lines 88 and 90 end. It will be seen that the glue flaps 80 include a notch or cutout 104 which does not affect the functioning of the carrier but provides space for the glue flaps 92 of an adjacent blank in the sheet from which the blanks are cut.

Figure 5:
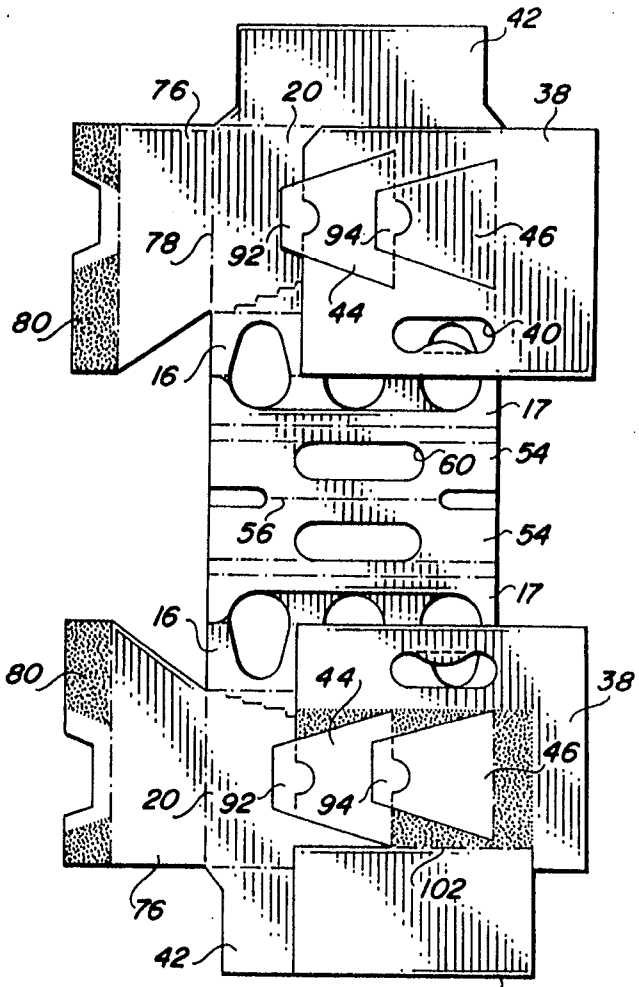
FIG. 5 is a plan view of the carrier blank after an initial folding step.

To form a carrier from the blank the glue flaps 92 and 94 of the divider flaps as well as the inner-ply handle panel sections 54 and the inner sloped panel sections 17 are coated with adhesive, as shown in stipple. The handle panel sections 38 are then folded in about the fold lines 84 and the combined inner-ply handle panel sections 54 and sloped panel sections 17 are folded in about their fold lines 58, as illustrated in FIG. 5. This adheres the glue flaps 92 and 94 to the side panel sections 20. It also adheres the inner-ply handle panel sections 54 and inner sloped panel sections 17 to the outer-ply handle panel sections 12 and the sloped panel sections 16.

The next step is to apply adhesive to the areas shown in stipple in FIG. 5. The center reinforcing panel 100 is then folded up about its fold line 102 and adhered to the adhesive on the internal handle panel section 38, following which the end panel flaps 76 are folded about their fold lines 78 and the glue flaps 80 adhered to the internal handle panel sections 38 and the folded reinforcing panel 100. After these operations the blank appears as in FIG. 6, with the adhered portions of the glue flaps 80 and the reinforcing flap 100 being out of contact with the divider flaps 44 so as not to interfere with the subsequent folding of the divider flaps.

Figure 6:
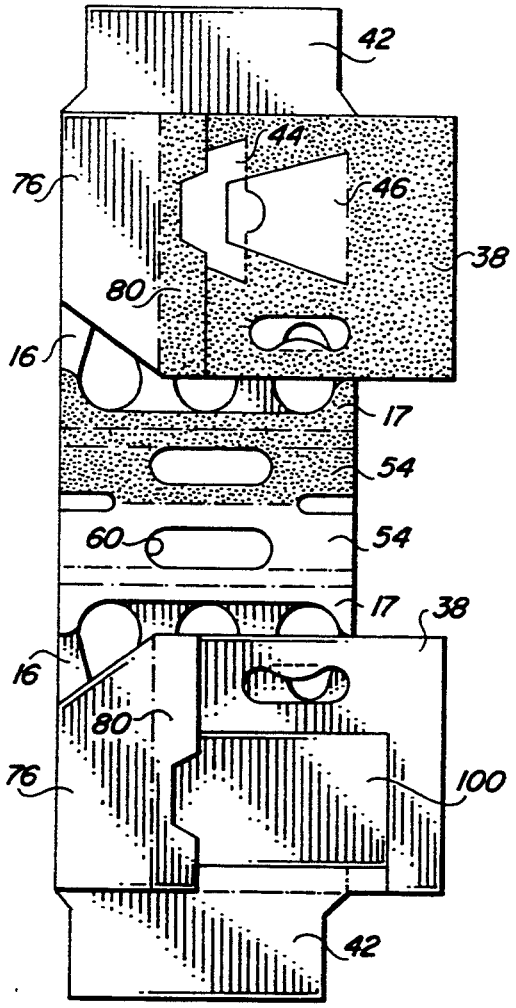
FIG. 6 is a plan view of the carrier blank after a second folding step.
Figure 7:
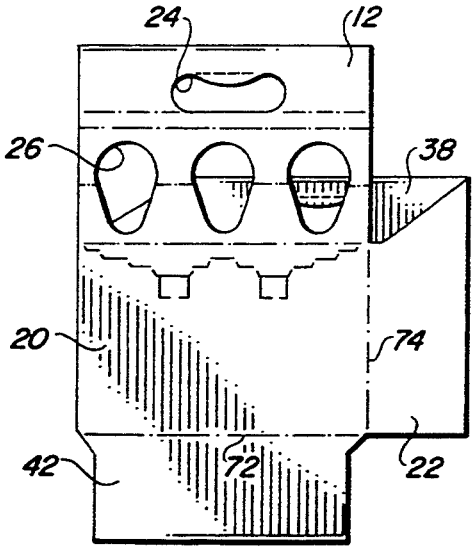
FIG. 7 is a plan view of a collapsed carrier resulting from a final folding step.

The final sequence of the forming operation is to apply adhesive to the stippled areas of the upper glue flap 80 as shown in FIG. 6, as well as to the upper internal handle panel section 38 and the upper inner-ply handle panel section 54. The blank is then folded along the aligned center fold lines 52 and 56. This results in the collapsed carrier illustrated in FIG. 7. The end panels formed from the end panel sections 22 extend in folded condition out to the right of the drawing and the end panels formed from the end panel flaps 76 are inwardly folded between the side panels.

Figure 8:
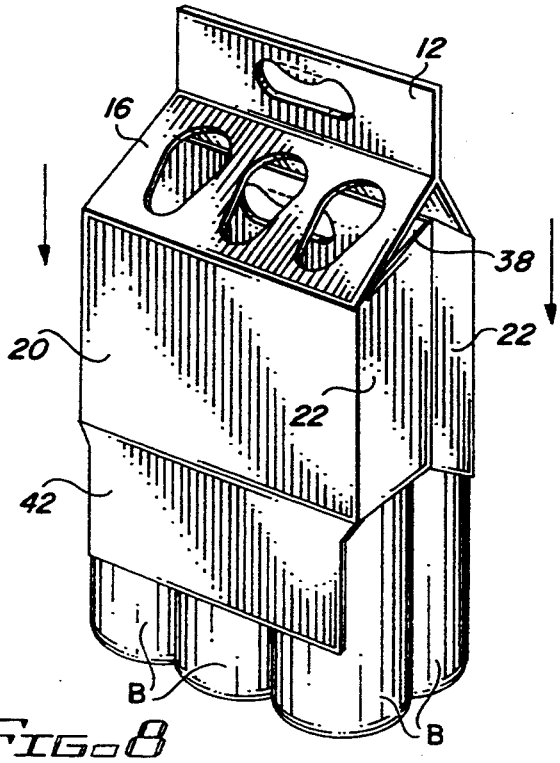
FIG. 8 is a pictorial view illustrating the loading of a carrier.

In this tent-style design the bottom panel flaps 42 are connected after loading bottles into the carrier. This can be best seen in FIG. 8, wherein the opened carrier is shown in the process of being lowered onto the bottles B. The bottom panel flap 42 is still unfolded, as is the opposite bottom panel flap. After the opened carrier has been pushed down over the bottles to the point where they fully extend through the bottle openings to the extent shown in FIG. 1, the flaps 42 are folded in and glued together in overlapped condition as the last step in forming the finished carrier.

The carrier has a number of advantages over prior art carriers. It is quite strong, having a four-ply external handle, a two-ply internal handle and a reinforced center panel section, and the opened carrier blank can be loaded onto the bottles to be packaged as in any typical tent-style carrier filling operation. The external handle section of the finished carrier provides a pilfer-proof feature which prevents individual bottles from being removed without first removing the entire outer handle section. When this is done the carrier, containing either full or empty bottles, can still be readily transported by the remaining inner handle section. Further, since the carrier essentially protects all but the bottle necks against light, by providing the necks with an opaque coating or cover the carrier can be used to package bottles containing light-sensitive liquid. All this is accomplished by a blank layout which is basically rectangular in shape and designed to economize on the amount of stock used to form the blank. As indicated earlier, the carrier size may be changed to accommodate fewer or greater numbers of bottles by changing the dimensions of the elements affecting the length of the carrier and adding or subtracting the number of cell dividers employed.

It is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A basket-style article carrier, comprising:

a bottom panel connected to opposite side panels, the side panels being connected to opposite end panels;

an external handle panel including a handle opening therein, the external handle panel extending substantially at right angles to the bottom panel when the carrier is lifted by the handle;

two intermediate panels, each intermediate panel connecting the external handle panel to an associated side panel, each intermediate panel being connected to the associated side panel;

easily severed means for removing the intermediate panels from the carrier;

an internal handle panel beneath the external handle panel, the internal handle panel being connected to the end panels and including a handle opening therein; and dividers extending from the internal handle panel to the side panels to form cells for receiving articles therein.

2. A basket-style article carrier as defined in claim 1, wherein the intermediate panels include openings therein through which upper portions of articles packaged in the carrier may extend.

3. A basket-style article carrier as defined in claim 1, wherein the easily severed means is comprised of an easily severed line extending substantially across the width of each side panel.

4. A basket-style article carrier as defined in claim 1, wherein the intermediate panels are unconnected to the end panels.

5. A basket-style article carrier as defined in claim 4, wherein each end panel is comprised of two end panel sections having adjacent substantially vertically extending folded edges, the folded edges being substantially aligned with an adjacent end of the inner handle panel.

6. A basket-style article carrier as defined in claim 5, wherein the bottom panel is comprised of two overlapping flaps, the flaps being connected to opposite side panels.

7. A basket-style article carrier as defined in claim 4, wherein the internal handle panel is comprised of two plies of material, each ply being integrally connected along an edge portion thereof to one of the end panels.

8. A basket-style article carrier as defined in claim 7, wherein the internal handle panel includes a third ply of material.

9. A basket-style article carrier as defined in claim 8, wherein the third ply of material is integrally connected along an edge portion thereof to one of the internal handle panel plies.

10. A basket-style article carrier as defined in claim 7, wherein the external handle panel is comprised of two outer plies and two inner plies of material, each of the outer plies being foldably connected to an associated intermediate panel.

11. A blank for forming a basket-style article carrier, comprising:

an external handle panel section including a central fold line and opposite edges;

an intermediate panel section connected to each opposite edge of the external handle panel section along a first fold line, each intermediate panel section having an edge opposite the first fold line, said opposite edge being connected to a side panel section along a second fold line;

each side panel section having opposite end edges, one end edge being connected to an end panel flap along a third fold line and the opposite end edge being connected to an end panel section along a fourth fold line;

each end panel section being connected to an internal handle panel section along a fold line;

each internal handle panel section including at least one foldably connected divider flap disposed in the plane of the internal handle panel section;

a bottom panel flap connected to at least one of the side panel sections; and easily severed means for removing the intermediate panels from a carrier formed from the blank.

12. A blank as defined in claim 11, wherein the intermediate panel sections include openings therein for receiving upper portions of articles packaged in a carrier formed from the blank.

13. A blank as defined in claim 12, wherein the external handle panel section includes a handle opening on opposite sides of the central fold line, the external handle panel of a carrier formed from the blank extending substantially at right angles to the bottom panel flap when the carrier is lifted by the handle.

14. A blank as defined in claim 11, wherein the easily severed means for removing the intermediate panels from a carrier formed from the blank is comprised of an easily severed line extending across the width of each associated side panel.

15. A blank as defined in claim 11, wherein a bottom panel flap is connected to each side panel, the bottom panel flaps overlapping in a carrier formed from the blank.

16. A blank as defined in claim 11, including a reinforcing flap connected along a fold line to one of the internal handle panel sections, the reinforcing flap being folded flat against said one internal handle panel section in a carrier formed from the blank to form a three-ply internal handle panel.

17. A blank as defined in claim 11, including a reinforcing external handle panel section connected to the external handle panel section along a fold line, the reinforcing external handle panel section forming with the external handle panel section a two-ply handle in a carrier formed from the blank.

18. A blank as defined in claim 17, including reinforcing intermediate panel sections, each said section being connected to an intermediate panel section along a fold line and being integrally formed with the reinforcing external handle panel section.

* * * * *